US007251436B2

(12) United States Patent
Minakuchi et al.

(10) Patent No.: US 7,251,436 B2
(45) Date of Patent: Jul. 31, 2007

(54) IMAGE FORMING DEVICE WITH MOVABLE PROCESSING UNIT

(75) Inventors: Yasunori Minakuchi, Nara (JP); Atsushi Ide, Nara (JP); Yoshinobu Tateishi, Nara (JP); Kazuhiro Matsuyama, Ikoma (JP); Toshiya Mikita, Yao (JP); Koichi Yamauchi, Yamatokoriyama (JP); Hiroshi Tachiki, Yamatokoriyama (JP); Koichi Nakamura, Kyoto (JP); Norio Tomita, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 1007 days.

(21) Appl. No.: 10/302,785

(22) Filed: Nov. 22, 2002

(65) Prior Publication Data

US 2003/0099476 A1 May 29, 2003

(30) Foreign Application Priority Data

Nov. 27, 2001 (JP) ..... 2001-361584
Nov. 12, 2002 (JP) ..... 2002-328843

(51) Int. Cl.
*G03G 15/00* (2006.01)

(52) U.S. Cl. ..... 399/122

(58) Field of Classification Search ..... 399/122, 399/320–342

See application file for complete search history.

(56) References Cited

U.S. PATENT DOCUMENTS 4,912,563 A * 3/1990 Narita ..... 399/110
5,237,340 A 8/1993 Nelson ..... 346/108
5,640,649 A 6/1997 Kikuchi et al. ..... 399/111

FOREIGN PATENT DOCUMENTS

| | | |
|---|---|---|
| EP | 0 384 467 A2 | 8/1990 |
| JP | 60-101550 | 6/1985 |
| JP | 10-312096 | 11/1998 |
| JP | 11-352860 | 12/1999 |
| JP | 2000-298383 | 10/2000 |
| JP | 2001166621 A * | 6/2001 |

OTHER PUBLICATIONS

European Search Report, Application No. EP 02 25 8160, mailed Mar. 20, 2003.

* cited by examiner

*Primary Examiner*—David M. Gray
*Assistant Examiner*—Ryan Gleitz
(74) *Attorney, Agent, or Firm*—Renner, Otto, Boisselle & Sklar, LLP

(57) ABSTRACT

An armored unit includes a side cover and a guide member. When sheet jam operation is carried out, a fixing unit is pulled out with the armored unit, and then is pushed to the rear side. This operation unlocks the lock member provided in the guide member, and a shoulder screw moves in a guide hole. Thus, the fixing unit is moved from the pulled out position toward the rear side and toward the main body of image forming device to be shifted to a receding position. On this account, it is possible to provide an image forming device ensuring sufficient space for removing a jammed sheet by hand with a small opening space.

15 Claims, 8 Drawing Sheets

IMAGE FORMING DEVICE WITH MOVABLE PROCESSING UNIT

FIELD OF THE INVENTION

The present invention relates to an image forming device which carries out image forming by transferring images formed on an image carrying body, such as a photocopier, a facsimile, or a printer.

BACKGROUND OF THE INVENTION

Conventionally, an image forming device performs image forming in such a manner that the device forms an image based on inputted image data from a built-in image scanning device, or based on inputted image data transmitted through external terminals, and transfers the formed image to a sheet (recording sheet), then fixes the transferred image to the sheet.

In this manner of image forming, when the sheet is sequentially carried to each processing unit to be subjected to those processing steps, paper jam occurs in some cases in the processing units or on the way to the processing units due to improper paper feeding, environmental change, or inadequate quality of the sheet.

To cope with this problem, an image forming device has a structure for enabling a user to remove a jammed sheet by opening the cover of the image forming device, or by pulling out the processing unit.

However, when a user opens the cover of the image forming device and pulls out the processing unit so as to remove a jammed sheet, sufficient space is required around the image forming device.

In this demand for a sufficient space around the image forming device for handling paper jam, remarkable downsizing of the recent image forming devices cannot provide desirable effect.

Particularly, in the case of a heat-fixing processing unit, the user have to pull a fixing unit in high temperature out of the image forming device with the processing unit when handling paper jam, and may mistakenly touch the fixing unit in high temperature.

Further, as the user pulls out the fixing unit in high temperature for obtaining enough space between the unit and the image forming device, sufficient space is required around the device. Thus, downsizing of the image forming device cannot provide a desirable effect since the whole space required for setting the device cannot be reduced.

SUMMARY OF THE INVENTION

The present invention is made in view of the foregoing conventional problems, and an object is to provide an image forming device which can provide sufficient space for removing a jammed sheet by hand with a small opening space.

In order to solve the foregoing problems, an image forming device of the present invention includes:

a processing unit for image forming to which a recording medium is sequentially carried for forming an image on the recording medium; and an armored unit as a part of armoring, which is capable of being exposed out of a main body of the image forming device, wherein: the processing unit is pulled out with the armored unit to be exposed out of the main body of the image forming device, and then is moved by being pushed in direction orthogonal to the direction in which the processing unit was pulled out.

With the foregoing arrangement, the processing unit is pulled out and exposed with the armored unit and is further moved by being pushed in in a direction orthogonal to the pulled out direction. Thus, a sufficient space is ensured for the working space for sheet jam operation etc. with respect to the main body of the image forming device, and also the processing unit is receded from the working side.

On this account, the working space for the sheet jam operation etc. is ensured even with a small pull out quantity of the armored unit, thus reducing occupancy area of the image forming device at a normal use.

Further, an image forming device of the present invention includes:

a fixing unit for fixing a toner image formed on a recording medium; and an armored unit as a part of armoring, which is capable of being exposed out of a main body of the image forming device, wherein: the fixing unit is pulled out with the armored unit to be out of the main body of the image forming device, and then is moved by being pushed in in a direction orthogonal to the direction in which the fixing unit was pulled out.

With the foregoing arrangement, the fixing unit is pulled out and exposed with the armored unit and is further moved by being pushed in in a direction orthogonal to the pulled out direction. Thus, a sufficient space is ensured for the working space for the sheet jam operation etc. with respect to the main body of the image forming device, and also the high-temperature fixing unit is receded from the working side.

On this account, the sheet jam operation etc. can be carried out easily and safely. Further, the working space for the sheet jam operation etc. is ensured even with a small pull out quantity of the armored unit, thus reducing occupancy area of the image forming device at a normal use.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 1(*b*) is a drawing showing an arrangement of a printer (image forming device) according to one embodiment of the present invention in the case where the fixing unit is in a receding state.

DESCRIPTION OF THE EMBODIMENTS

Figure 1:
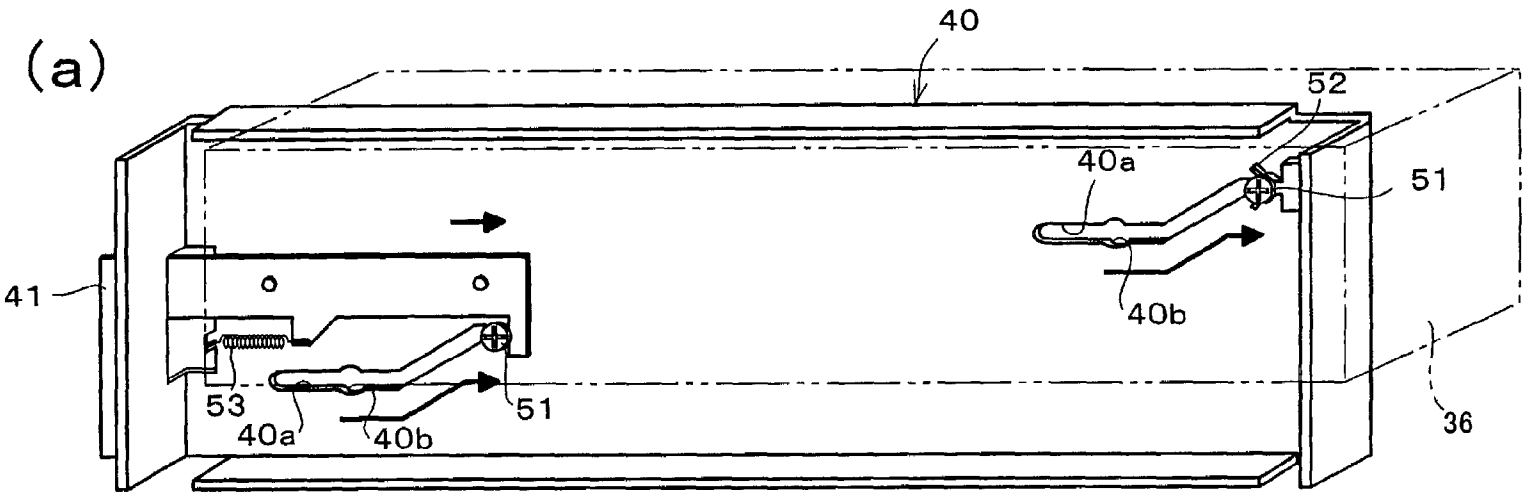
FIG. 1(*a*) is a drawing showing an arrangement of a printer (image forming device) according to one embodiment of the present invention in the case where a fixing unit is in a fixed position, or in the case of image forming.
Figure 1:
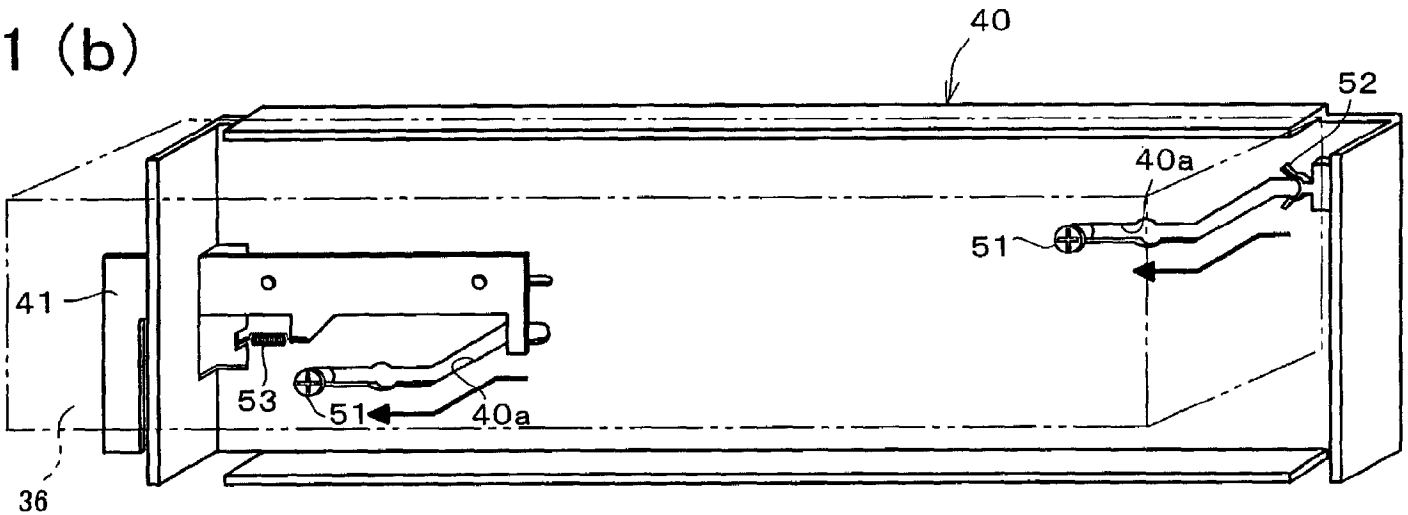

The following will explain one embodiment of the present invention with reference to FIGS. 1(*a*), 1(*b*) through 8.

Figure 2:
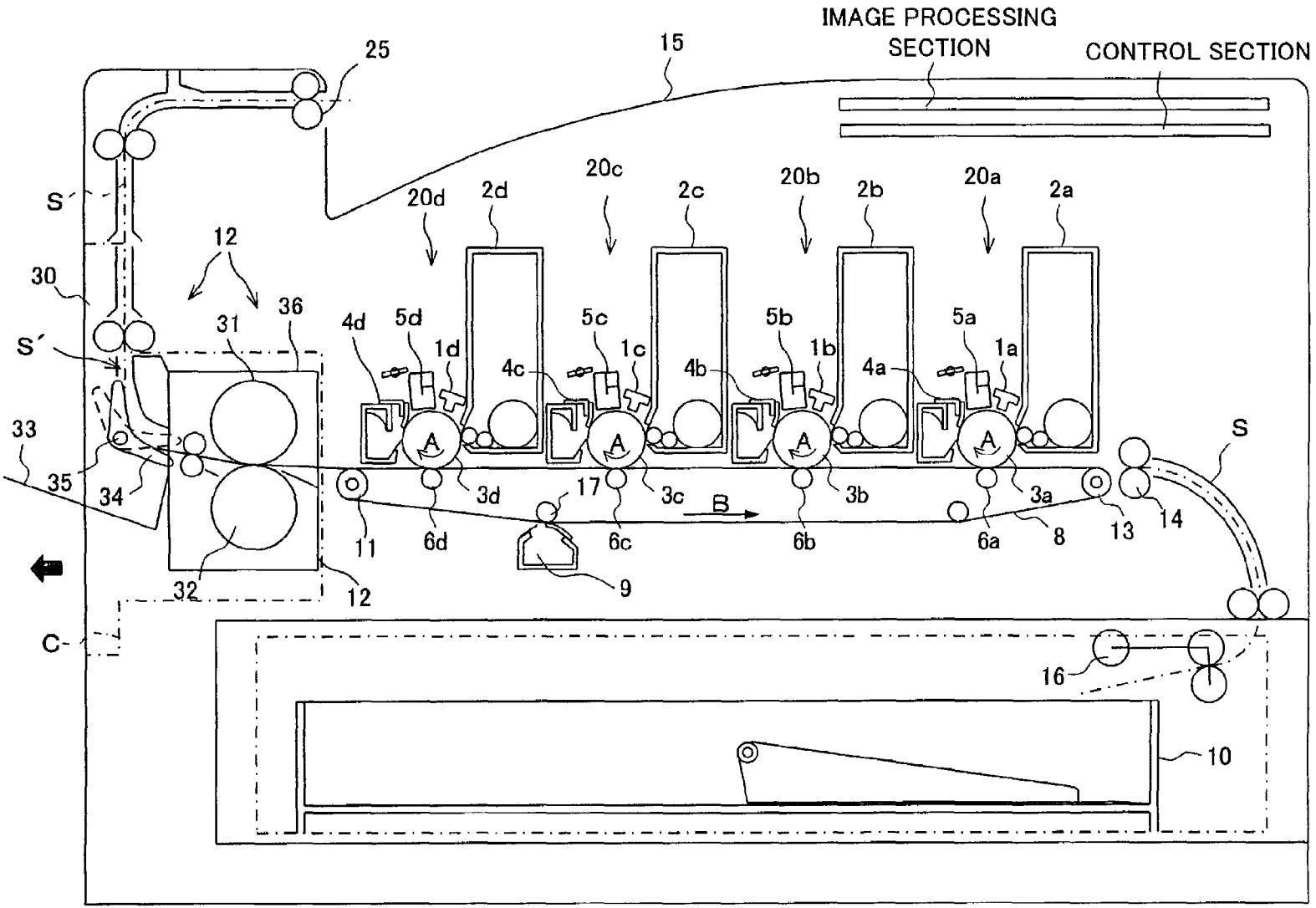
FIG. 2 is a drawing schematically showing an arrangement of a printer according to one embodiment of the present invention.

FIG. 2 is a drawing showing an arrangement of a printer (image forming device) according to the present embodiment. The printer carries out image forming of a single-colored image and a multicolored image with respect to a predetermined sheet (a transfer sheet, or a recording medium) based on externally transmitted image information. The document image is scanned by a document scanning section (not shown) including a CCD (Charge Coupled Device), and is processed by an image processing section, and then is inputted to an image forming sections 20*a* through 20*d* as the image information.

As shown in FIG. 2, the printer is equipped with the image forming sections 20*a* through 20*d*, a transfer belt (carriage belt) 8, a fixing unit (processing unit) 36, a paper feeding tray 10, feeder output trays 15 and 33, and other components.

The image forming sections 20*a* through 20*d* have essentially the same arrangements, and each has a function for respectively transferring a black (K) image, a cyan (C) image, a magenta (M) image, and a yellow (Y) with respect to a sheet.

The image forming sections 20*a* through 20*d* include LED heads 1*a* through 1*d*, developing devices 2*a* through 2*d*, photoconductive drums 3*a* through 3*d*, cleaner units 4*a* through 4*d*, charged units 5*a* through 5*d*, and transfer rollers 6*a* through 6*d*.

In another way, the image forming section 20*a* forming a black (K) image includes a LED head 1*a*, a developing device 2*a*, a photoconductive drum 3*a*, a cleaner unit 4*a*, a charged unit 5*a*, and a transfer roller 6*a*. Similarly, the image forming section 20*b* forming a cyan (C) image includes a LED head 1*b*, a developing device 2*b*, a photoconductive drum 3*b*, a cleaner unit 4*b*, a charged unit 5*b*, and a transfer roller 6*b*. Also, the image forming section 20*c* forming a magenta (M) image includes a LED head 1*c*, a developing device 2*c*, a photoconductive drum 3*c*, a cleaner unit 4*c*, a charged unit 5*c*, and a transfer roller 6*c*. Further, the image forming section 20*d* forming a yellow (Y) image includes a LED head 1*d*, a developing device 2*d*, a photoconductive drum 3*d*, a cleaner unit 4*d*, a charged unit 5*d*, and a transfer roller 6*d*.

In the respective image forming sections 20*a* through 20*d*, the LED heads 1*a* through 1*d*, the developing devices 2*a* through 2*d*, the transfer rollers 6*a* through 6*d*, the cleaner units 4*a* through 4*d*, the charged units 5*a* through 5*d* are disposed in this order around the photoconductive drums 3*a* through 3*d* along the direction denoted by the arrow A.

The photoconductive drums 3*a* through 3*d* are cylindrical drums respectively having photoconductive material on their surfaces, and are disposed (placed) on a substantially central portion of the printer. Further, the photoconductive drums 3*a* through 3*d* are driven in the direction denoted by the arrow A.

The charged units 5*a* through 5*d* are charging means for evenly charging the photoconductive drums 3*a* through 3*d* to a predetermined potential. The charged units 5*a* through 5*d* are not limited to the charger shaped unit shown in FIG. 2 as long as they have a function for respectively charging the photoconductive drums 3*a* through 3*d*; for example, they may be contact roller type charging units, or brush shaped charging units.

The LED heads 1*a* through 1*d* are exposure devices to which corresponding pixel signals (image data) for the color component of black, cyan, magenta, and yellow in the image information are inputted.

The LED heads 1*a* through 1*d* include light emitters in an array state. The LED heads 1*a* through 1*d* lead the light emitted from the photoconductive drums 3*a* through 3*d* with a rod lens array, and carry out exposure of the charged photoconductive drums according to the inputted pixel signal. As a result, an electrostatic latent image is formed on the surface of the photoconductive drums 3*a* through 3*d* according to the pixel signal (image information).

Note that, there is no specific limitation for the LED heads 1*a* through 1*d* as long as capable of performing exposure on the photoconductive drums 3*a* through 3*d*, and they may be an EL (Electro Luminescence) writing head having other light emitters in an array state, or a LSU (Laser Scanner Unit) for scanning the photoconductive drums 3*a* through 3*d* by deflecting laser beam from a laser emitting diode with a polygon mirror, for example.

The developing devices 2*a* through 2*d* respectively store black toner, cyan toner, magenta toner, and yellow toner. C The developing devices 2*a* through 2*d* develop each electrostatic latent image formed on the respective photoconductive drums 3*a* through 3*d* by using these color toners so as to create toner images.

The cleaner units (cleaning device) 4*a* through 4*d* has a cleaning blade. The cleaning blade is provided slidably in contact with each of the photoconductive drums 3*a* through 3*d*. The cleaner units 4*a* through 4*d* remove/collect the remaining toner or paper dust on the photoconductive drums 3*a* through 3*d* by the respective cleaning blades after the transfer of the toner image to a sheet.

The transfer rollers 6*a* through 6*d* are corona discharge units for transferring each of the toner images on the photoconductive drums 3*a* through 3*d* to a sheet on the transfer belt 8. The transfer rollers 6*a* through 6*d* are in contact with the rear side of the transfer belt 8 while being opposite to the corresponding photoconductive drums 3*a* through 3*d* having the transfer belt 8 in-between.

The transfer rollers 6*a* through 6*d* are respectively supplied with a high voltage (a high voltage in the reverse polarity (+) of the charging polarity of the toner (−)) from a high voltage power source unit (not shown) for transferring the toner images. Further, the transfer rollers 6*a* through 6*d* have a metal (for example, stainless) axis with the diameter of 8 to 10 mm as the base, and have a roller coated with a conductive elastic material (for example, EPDM (ethylene propylene), urethane form or the like) on the surface. The sheet is evenly supplied with a high voltage by the conductive elastic material.

Further, the transfer rollers 6*a* through 6*d* are supported by the axis while being rotatable, and hold and stretch the transfer belt 8 in conjunction with a driving roller 11, a coupled driving roller 17, and a tension roller 13. The transfer rollers 6*a* through 6*d* transfer the toner images on the photoconductive drums 3*a* through 3*d* to the sheet, which is stuck on the transfer belt 8 to be carried therewith.

The transfer belt 8 is made of a film with the thickness of about 100 to 150 μm and formed to be an endless state. The transfer belt 8 is rotated for driving in a sheet carriage direction (denoted by the arrow B in the figure). Further, the photoconductive drums 3*a* through 3*d* are provided in this order in the direction B (from the left of the figure) by being in contact with the transfer belt 8.

The toner images in various colors are sequentially transferred to the sheet by overlaying each other while being carried by the transfer belt 8 so that a color toner image (multicolored toner image) formed on the sheet is carried to a fixing unit 36.

The fixing unit 36 includes a heat roller (roller) 31 and a pressurization roller (roller) 32. The fixing unit 36 performs heat fixing for the transferred unfixed toner image into the sheet through fusing, mixing, and crimping. The heat roller 31 and the pressurization roller 32 are rotated by having the sheet therebetween. Further, the heat roller 31 is adjusted to a predetermined fixing temperature by a control section in accordance with an output signal from a temperature detector (not shown). The fixing unit 36 will be described later.

Further, the transfer belt cleaning unit 9 removes/collects the toner coming from the photoconductive drums 3*a* through 3*d* from the transfer belt 8 so as not to make stains on the rear surface of the sheet.

The paper feeding tray 10 stores sheets for image forming, and is provided on a lower portion of the image forming sections 20*a* through 20*d* of the printer. Further, the feeder output tray 15 provided on an upper portion of the printer is a tray for placing the sheets having formed images face-down. The feeder output tray 33 provided on a lateral portion of the printer is a tray for placing the sheets having formed images faceup.

Further, a sheet carriage path (carriage path) S reclivate in shape is provided in the printer for sending the sheet from the paper feeding tray 10 to the feeder output tray 15/33 via the transfer belt 8 and a fixing unit 36. In the vicinity of the sheet carriage path S extended from the paper feeding tray 10 to the feeder output tray 15/33, a pickup roller 16, a resist roller 14, the fixing unit 36, a carriage direction switching gate 34, and a carriage roller 25 are provided.

The carriage roller 25 is a small-sized roller for accelerating/subserving the carriage of the sheet, and is provided on plural portions along the sheet carriage path S.

The pickup roller 16 is a take-in roller provided on an end of the paper feeding tray 10 for singly supplying the sheet from the top of the paper feeding tray 10 to the sheet carriage path S.

The carriage direction switching gate 34 is provided on a side cover (armored unit) 30 of the main body of the printer while being rotatable. The carriage direction switching gate 34 is rotated about a rotation supporter 35 so as to switch the discharge of the sheet between the feeder output tray 15 and the feeder output tray 33.

More specifically, the carriage direction switching gate 34 moves from the state denoted by a solid line in FIG. 2 to the state denoted by a broken line so as to divide the sheet from the sheet carriage path S to be discharged to the feeder output tray 33.

Further, when the carriage direction switching gate 34 is in the state denoted by the broken line in FIG. 2, the sheet passes through a carriage section (carriage path) S' (a portion of the sheet carriage path S) formed between the fixing unit 36 and the side cover 30, then is carried to a reverse output route of the sheet carriage path S by the carriage roller 25. And then, the reversed sheet (with the multicolored toner image facing down) is discharged to the upper feeder output tray 15.

The resist roller 14 temporarily holds the sheet in the sheet carriage path S. Further, the resist roller 14 has a function for timing the carriage of the sheet to the rotation of the photoconductive drums 3*a* through 3*d* so as to desirably perform the overlay transfer of the toner images on the photoconductive drums 3*a* through 3*d* to the sheet.

More specifically, the resist roller 14 carries the sheet by matching the edges of the toner images on the photoconductive drums 3*a* through 3*d* to the edge of printing area of the sheet in accordance with the detection signal outputted from a resist pre-detection switch (not shown).

Note that, here, the image forming device is explained as a color printer; however, an image forming device having a single image forming station may be adopted instead.

The sheet thus taken from the paper feeding tray 10 by the pickup roller 16 is carried in the sheet carriage path S while being reversed. The sheet is temporarily held by the resist roller 14, and then is sent to the transfer belt 8 in a predetermined timing.

Further, the sheet is carried by the transfer belt 8 circularly moving in the direction B, and sequentially passes through four transfer sections between the photoconductive drums 3*a* through 3*d* and the transfer rollers 6*a* though 6*d* which are opposed to each other. Here, the transfer section refers to an area where the toner images on the photoconductive drums 3*a* through 3*d* are transferred by the transfer roller 6*a* through 6*d*.

More specifically, the sheet is carried in the same timing as that the edge of the toner image on the respective photoconductive drums 3*a* through 3*d* reaches to the transfer section so that the image forming starting position of the sheet also reaches to the transfer section. The transfer rollers 6*a* through 6*d* respectively apply a high voltage (transfer bias) supplied from a high voltage power source (not shown) to a sheet via the transfer belt 8. Then, the transfer bias enables the transfer of the toner images on the photoconductive drums 3*a* through 3*d* to the sheet.

The toner images are sequentially overlaid and transferred to the sheet at the four transfer sections, and then the sheet is carried to the fixing unit 36 to fuse the transferred toner image into the surface of the sheet by applying heat and pressure. Then, the sheet is discharged out of the device.

The following will explain an arrangement of the fixing unit 36 and procedures of sheet jam operation in the fixing unit 36 with reference to FIGS. 1, 3 through 6.

Firstly, the following will explain an arrangement of the fixing unit 36.

The fixing unit 36 is included in an armored unit 12. The armored unit 12 has a side cover 30, a guide member 40, and a protect member 41.

Figure 5:
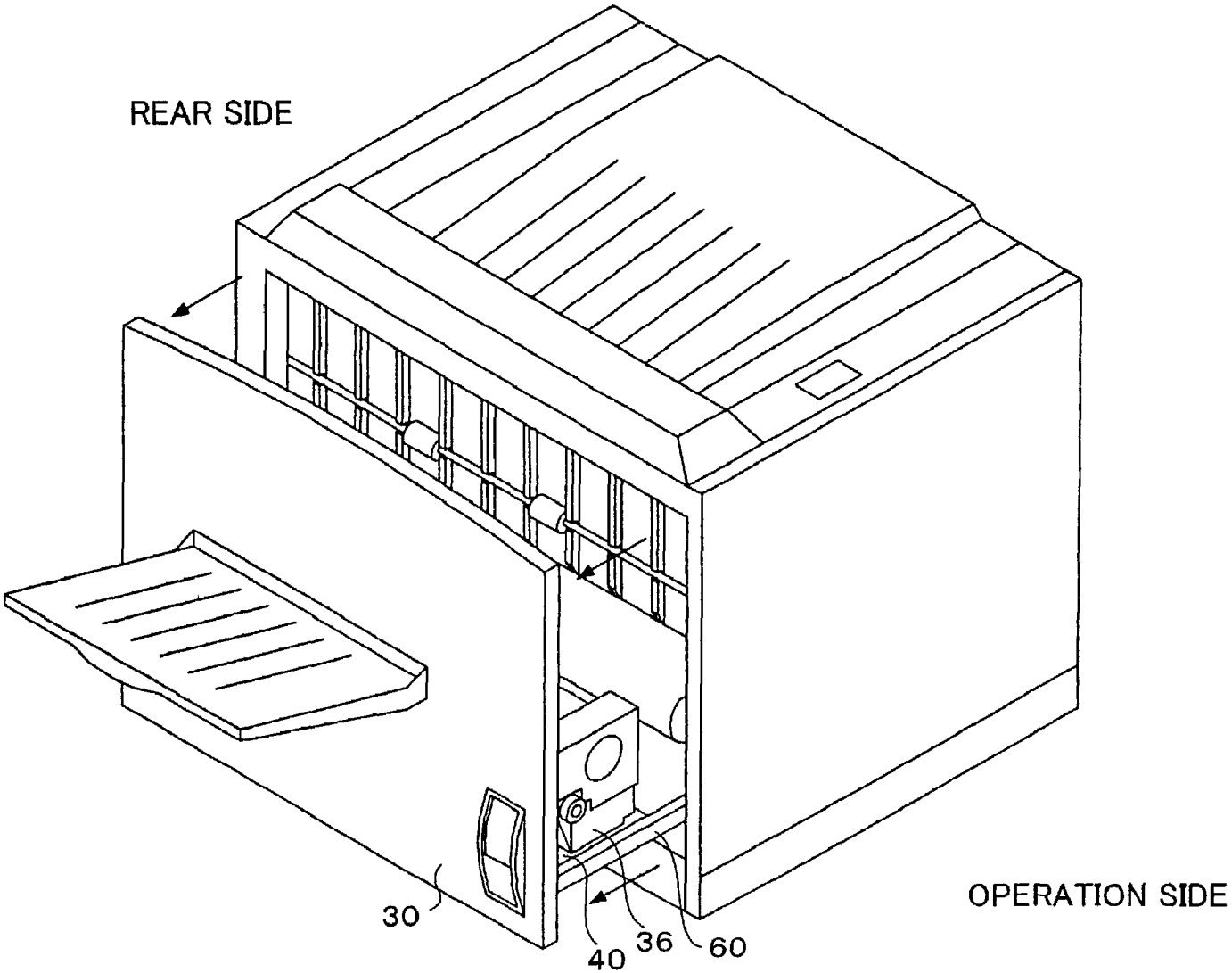
FIG. 5 is a perspective view showing an arrangement of a printer in a state where a fixing unit and a side cover are pulled out.
Figure 6:
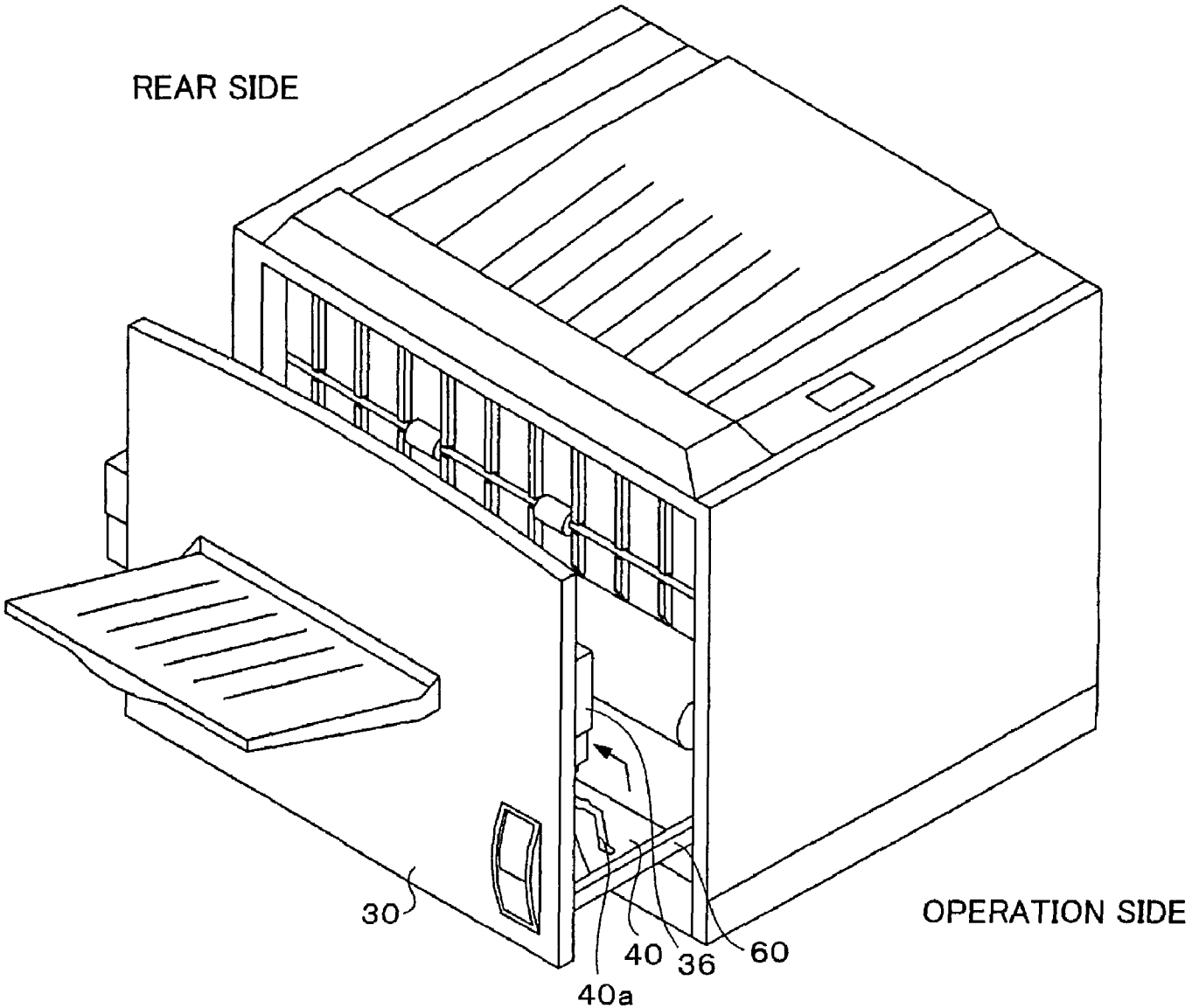
FIG. 6 is a perspective view showing an arrangement of a printer in the case where a fixing unit is in a receding state.

As shown in FIGS. 5 and 6, the fixing unit 36 is disposed on the guide member 40, and is slidably supported. Further, the protect member 41 is provided on the guide member 40 as shown in FIGS. 1(*a*) and 1(*b*).

Figure 3:
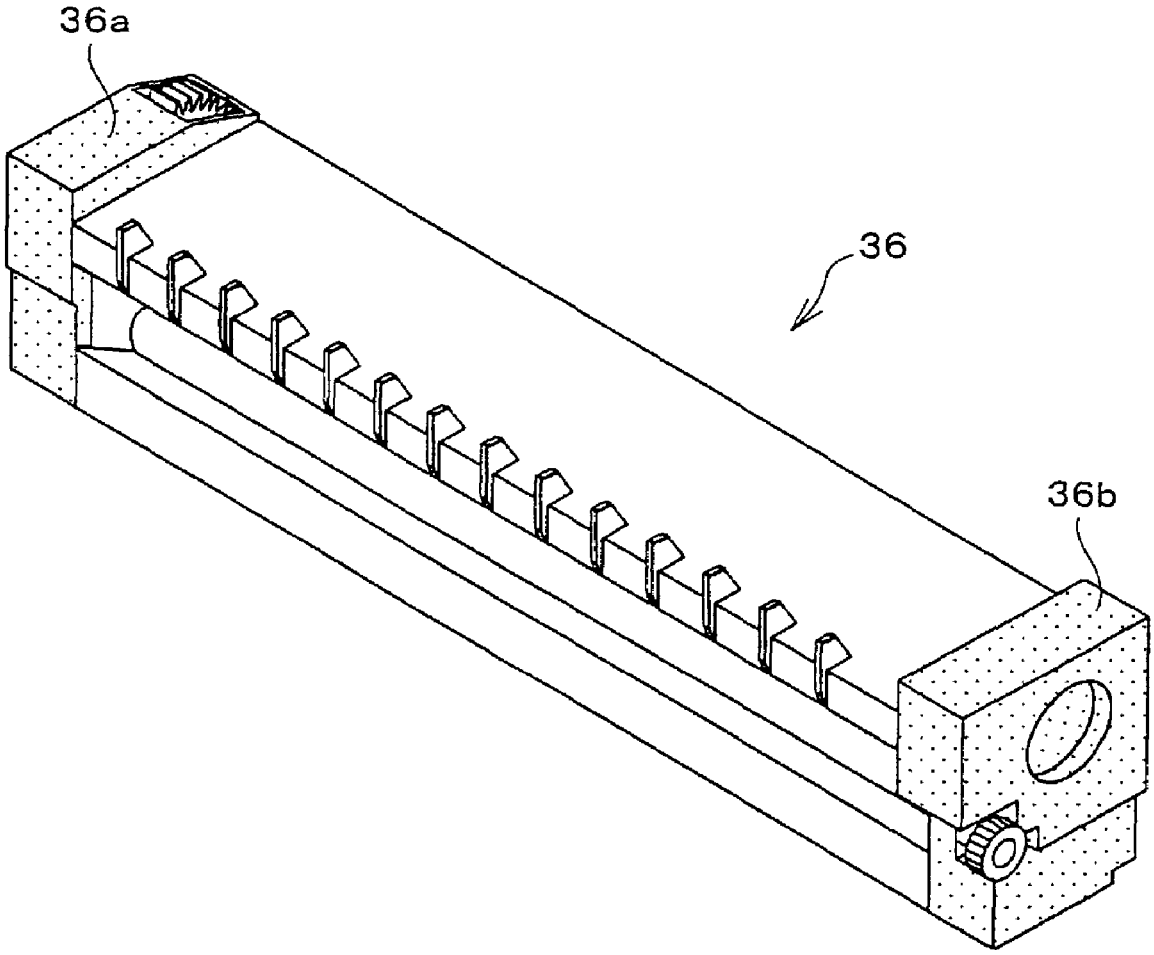
FIG. 3 is a perspective view showing an arrangement of a major part of a fixing device.

As shown in FIG. 3, the ends 36*a* and 36*b* of the fixing unit 36 are covered with PBT (polybutylene terephthalate) (heat-resistant material), for example.

As described, by covering with PBT (heat-resistance material) each periphery portion of the ends 36*a* and 36*b* of the fixing unit 36 where the motive power between the fixing unit 36 and the main body of the printer (image forming device) is given and sent, it is possible to prevent the ends 36*a* and 36*b* from being damaged or stained even when the ends 36*a* and 36*b* are accidentally touched with, for example, a wall, other devices or a desk, which are placed near the rear surface of the printer.

Further, it is possible to prevent direct contact with the fixing unit 36 by a user even when the user mistakenly touches the fixing unit 36 in high temperature. Further, it is possible to reduce radiation from the fixing unit 36 by covering the ends 36*a* and 36*b* with PBT.

FIG. 1(*a*) shows an arrangement in the rear side of the guide member 40 in the case of image forming, or in the case where the fixing unit 36 is pulled out with a part of the side cover 30 (a part of the armored unit, see FIG. 5). This position (shown by a chain double-dashed line) of the fixing unit 36 is hereinafter referred to as a fixed position.

FIG. 1(*b*) shows an arrangement of the rear side of the guide member 40 in the case where, only the fixing unit 36 is further moved to the rear side (to left side in the figure, the back side of the printer) after the fixing unit 36 is pulled out with the part of the side cover 30. This state (shown by a chain double-dashed line) of the fixing unit 36 is hereinafter referred to as a receding state and the position of the fixing unit is referred to as a receding position.

The guide member 40 has two guide holes (opening) 40*a*/40*a*. The fixing unit 36 is mounted to the guide member 40 with two shoulder screws 51/51 by fastening from the rear side (rear side of the guide holes 40*a*). The shoulder screw is guided in the guide hole 40*a* so that the fixing unit 36 can move on the guide member 40.

The two guide holes 40*a*/40*a* of the guide member 40 are disposed to be substantially diagonal and in parallel in the guide member 40 so that the fixing unit 36 is stably supported for moving. Further, a lock member 52 made of plastic with high elasticity and self-lubricating property, such as POM (polyoxymethylene), is provided on the end of the fixed position of the guide holes 40*a* of the guide member 40.

As described, the fixing unit 36 is movable by the guide holes 40*a* in an orthogonal and slightly parallel direction to the carriage direction of the sheet carried to the fixing unit 36. Further, when the fixing unit 36 is shifted, the fixing unit 36 may be mover to the rear side of the printer.

On this account, sliding movement of the fixing unit 36 can smoothly be carried out.

Further, it is possible to accurately mount the side cover 30 and the fixing unit 36 on a right position by having the guide hole 40*a* and the lock member 52. Namely, it is possible to prevent the fixing unit 36 from being inclined or shifted from the fixed position at the image forming.

Further, the fixing unit 36 is stopped short of touching a surface of a back cover (see FIG. 4) by the guide hole 40*a*. The back cover is an armoring of the main body of the image forming device provided in the moving direction of the fixing unit 36 (the direction in which the fixing unit 36 is moved). In the present embodiment, the fixing unit 36 is stopped in a position 20 mm from a surface of a back cover; however, the present invention is not limited to this arrangement. For example, the stopping position may slightly be closer than 20 mm from the surface; however, it still preferably stops before the surface of the back cover.

On this account, it is possible to prevent the fixing unit 36 from being bounced out of the armoring of the printer. Thus, it is possible to prevent crush of the fixing unit 36 with such as a wall, thereby preventing the scratch of the wall or breakage of the fixing unit 36 (processing unit).

Further, the guide hole 40*a* has the lock member 52 for regulating the movement of the fixing unit 36 at a movement end (limit the movement range and fix the position at a movement end) at least on a portion (fixed portion) in the printer where the fixing unit 36 carries out the image forming.

With this arrangement, when the fixing unit 36 and the side cover 30 are moved back to the original position after being pulled out for the sheet jam operation, it is possible to keep the fixing unit 36 fixed in the right position (fixed position) so as not to be easily moved due to vibration from the movement. Further, the fixing unit 36 is tightly held also at image forming, and will not moved from the fixed position due to vibration of the operation.

Further, the protect member 41 is mounted to the guide member 40 with a bias force toward the outside of the guide member 41 (in an opposite direction of the arrow in FIG. 1(*a*)) by an elastic member (spring) 53 made of an extension spring or the like.

As shown in FIG. 1(*a*), when the fixing unit 36 is in the fixed position, the shoulder screw 51 is fixed to an end of the guide hole 40*a* by the lock member 52. Here, on the side having the protect member 41, one end of the protect member 41 is latched by the shoulder screw 51. Here, the elastic member 53 is being extended toward the front side of the printer (in the direction denoted by a middle arrow in FIG. 1).

At this point, the protect member 41 is least extended toward the rear side, and therefore the protect function does not work.

Further, when the fixing unit 36 is moved to the receding position, as shown in FIG. 1(*b*), the block by the protect member 41 is released, and the protect member 41 is pulled out to the rear side by the elastic member 53. The protect function works at this point, but the details of this protect function will be described later.

Note that, the lock member may be provided on the other end of the guide hole 40*a* though it is not provided in FIGS. 1(*a*) and 1(*b*). In this arrangement, it is possible to hold the fixing unit 36 when the fixing unit 36 is in the receding state. As a result, the working space for the sheet jam operation is ensured as well as security for the work.

Further, a unit removal hole 40*b* is formed on the guide hole 40*a*. When the fixing unit 36 is removed from the guide member 40, the shoulder screw 51 is set in the unit removal hole 40*b* and is pulled upward with respect to the fixing unit 36. As a result, the fixing unit 36 is easily removed from the guide member 40. In this manner, the fixing unit 36 can be removed from the guide member 40 without taking out the shoulder screw from the rear side of the guide member 40.

Note that, here, the fixing unit 36 is used as the processing unit which is pulled out and moved for carrying out the sheet jam operation; however the present invention is not limited to this arrangement. For example, as shown in FIG. 8, a transfer unit 66 may be pulled out as the processing unit.

Figure 8:
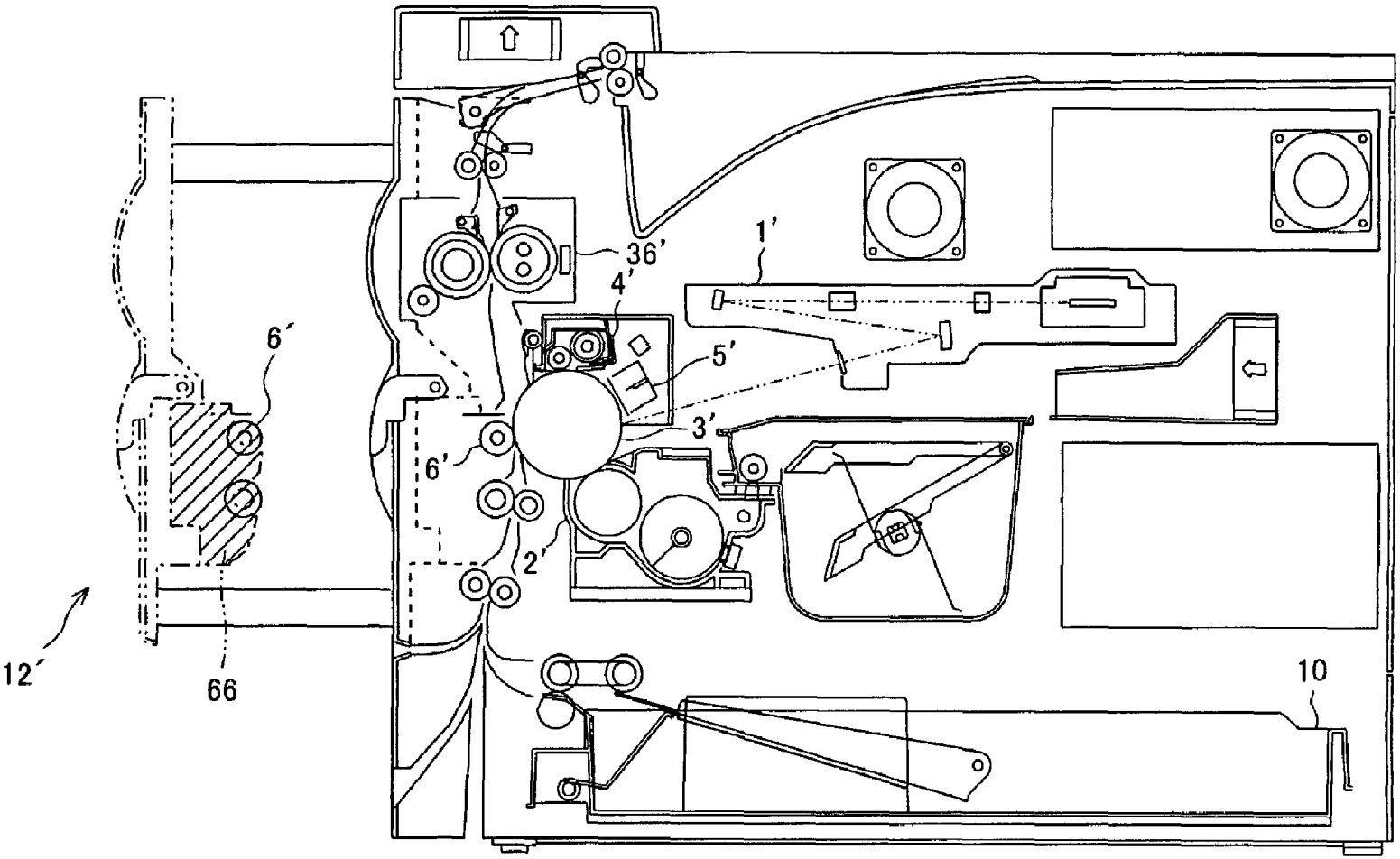
FIG. 8 is a drawing showing an arrangement of a main part of an image forming device capable of pulling out a transfer unit with a side cover.

In this case, as shown in FIG. 8, the transfer unit 66 includes a transfer roller 6'. The transfer unit 66 is pulled out from the main body of the printer with an armored unit 12', and then is further moved to the rear side with respect to the armored unit 12'. With this operation, a sufficient working space is ensured even with a small pull out quantity of the armored unit 12', thus easily carrying out sheet jam operation with respect to the transfer section.

Note that, the LSU1' shown in FIG. 8 is an exposure device. Further, a developing device 2', a photoconductive drum 3', a cleaner unit 4', a charged unit 5', and a transfer roller 6' respectively correspond to the developing devices 2*a* through 2*d*, the photoconductive drums 3*a* through 3*d*, the cleaner units 4*a* through 4*d*, the charged units 5*a* through 5*d*, and the transfer rollers 6*a* through 6*d* shown in FIG. 2 and they all have the same arrangements/functions as those of the corresponding members.

Figure 4:
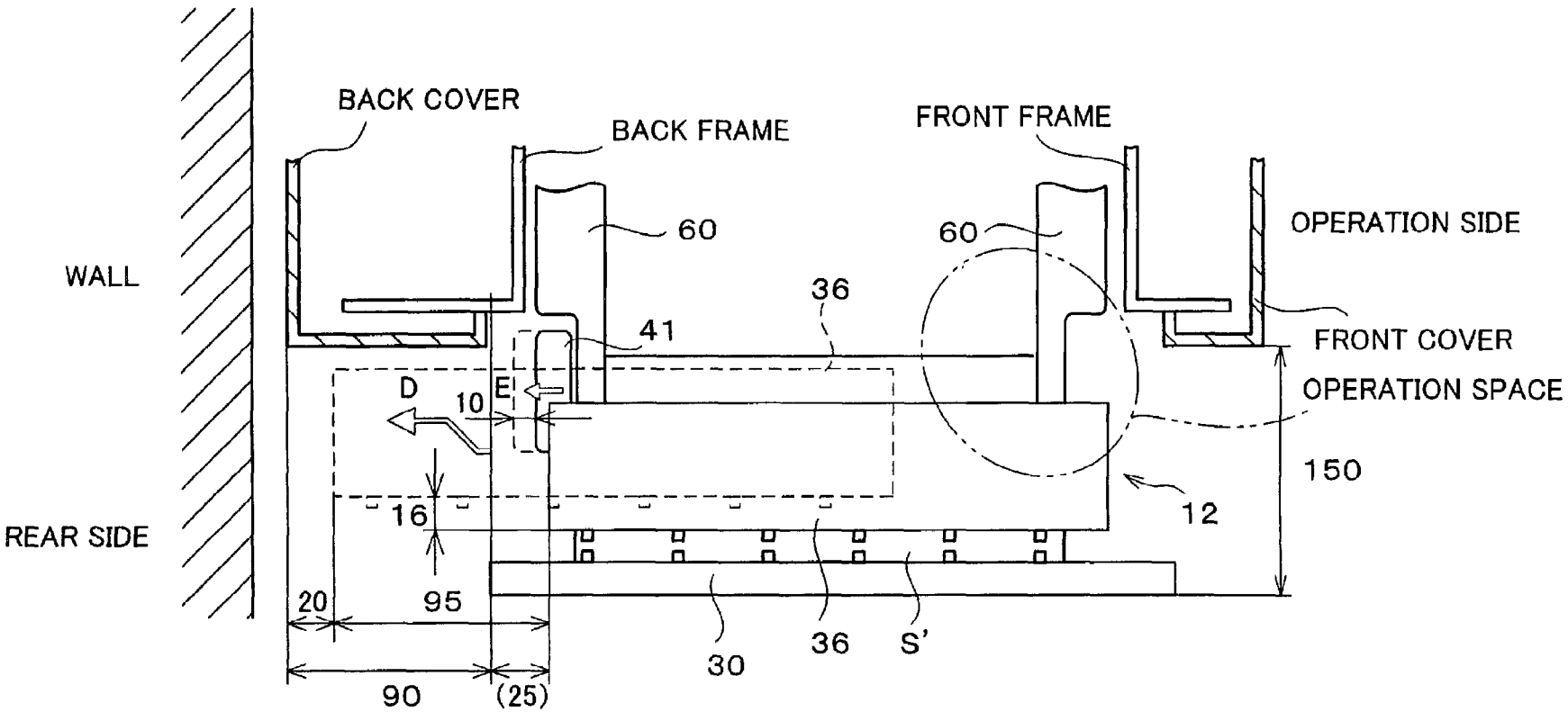
FIG. 4 is a drawing showing a movement of a fixing unit.

Next, the following will explain the procedures of the sheet jam operation in the vicinity of the fixing unit 36 with reference to FIGS. 2, 4, and 5.

When the sheet jam operation is carried out, the processing unit (the fixing unit 36 in this case) to be receded is externally pulled out (exposed) with the armored unit 12, which is a part of the armoring (with a side cover 30). When the processing unit is the fixing unit 36, the portion denoted by a chain dashed line in FIG. 2 is pulled out to expose the unit. In the present embodiment, as shown in FIG. 4, the fixing unit 36 and the side cover 30 are pulled out by 150 mm toward the lateral portion of the image forming device. Thus, the opening space (exposure) of the side cover 30 (armored unit) is approximately 150 mm.

Figure 7:
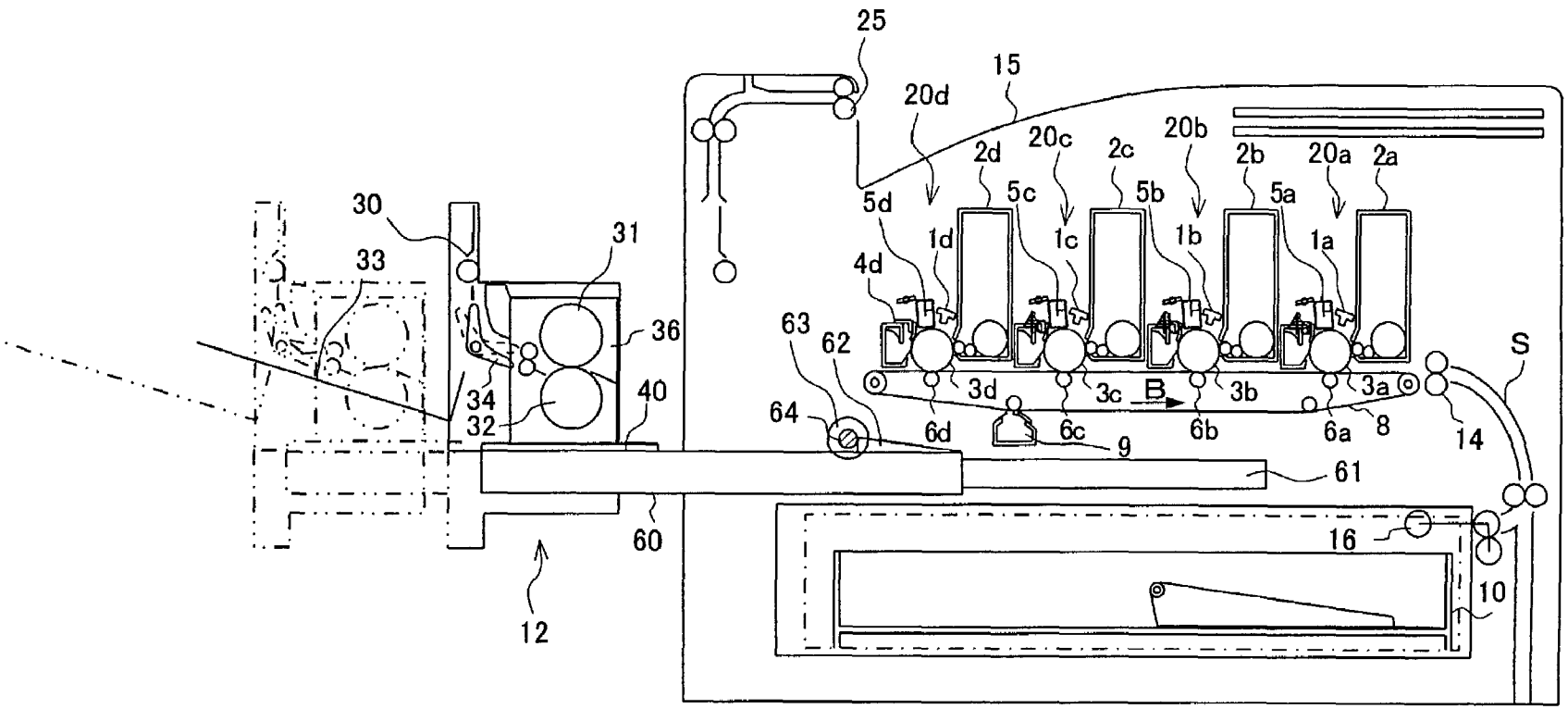
FIG. 7 is a drawing showing an arrangement of a side cover and an opening restricting means for opening the side cover.

This opening space is restricted to be about 150 mm by an opening restricting means. However, as shown in FIG. 7 (shown by a chain double-dashed line), it is possible to extend the opening space to be about twice i.e., 300 mm by controlling the opening restricting means at maintenance of the main body of the image forming device by a service person, for example. With this function, it is possible to easily carry out the maintenance of the device.

The opening restricting means is provided on the operation side. More specifically, a restricting axis 64 on a front end of a restricting knob 63 is supplied with a bias force from outside to inside of the printer by a coil spring or the like (not shown) so as to be engaged with a restricting member 62 provided on a slide supporting member 60. In this manner, the pull out quantity of the armored unit 12 is restricted.

Further, the armored unit 12 is further pulled out when it is pulled out by pulling the restricting knob 63 forward (to the user's side) (the state shown by a chain double-dashed line in FIG. 7). The restricting knob 63 may be externally provided out of the front cover, or may be provided inside of the front cover so as to be operated by opening the front cover.

FIG. 5 shows a state where the fixing unit 36 included in the armored unit 12 is pulled out by pulling the side cover 30. The armored unit 12 made up of the guide member 40 and the side cover 30 etc. are pulled out by sliding with the slide supporting member 60 shown in FIG. 5.

The slide supporting member 60 is made of a sliding material such as Accuride®. As shown in FIG. 7, this sliding material operates as a slide bearing by being supported with a ball member or the like (not shown) on a supporting section 61 as a base tightly fixed to a frame member (a front frame, a back frame, see FIG. 4) so that the slide supporting material 60 is smoothly slidable.

Then, when the fixing unit 36 is pushed toward the rear side, the force for pushing unlocks the lock member 52 and the shoulder screw 51 is moved on the guide hole 40*a*. Here, when the fixing unit 36 is pushed toward the rear side, for example, a handle or the like may be provided on the end of the fixing unit 36 for this pushing operation instead of directly pushing from the end of the fixing unit 36.

With this operation, the fixing unit 36 is moved in the direction denoted by the arrow D in FIG. 4, i.e., from the fixed position denoted by the solid line to the receding position denoted by the broken line. Consequently, the pulled out fixing unit 36 is moved toward the rear side by 95 mm, and also is moved to the upper side in the sheet carriage direction (toward inside of the printer) by 16 mm.

By thus moving the fixing unit 36 to the rear side by 95 mm and to inside by 16 mm with respect to the main body of the printer, the working space (a space for the sheet jam operation by hand with respect to the main body of the printer) shown in FIG. 4 can be ensured while opening the carriage section S' (see FIG. 2). Therefore, sheet jam operation can be carried out with respect to both the inside of the main body and the carriage section S'. The moving quantity of the fixing unit 36 is not limited to the foregoing value, and may be set to an appropriate value for easily carrying out sheet jam operation according to the size of the image forming device and the shapes of the components.

Generally, when the fixing unit 36 is not moved to the receding position (when the fixing unit 36 is not moved from the side cover 30), the necessary opening space (exposure) of the side cover 30 for performing the sheet jam operation is approximately 250 mm; and to further ease the operation, the necessary opening space is approximately 300 mm.

However, when only the fixing unit 36 is pushed in inside of the main body of the printer by 16 mm after being exposed out of the printer with the side cover 30, the working space for sheet jam operation will hardly be reduced. Thus, the working space for the sheet jam operation is ensured even with a smaller opening space (150 mm).

FIG. 6 shows a state where the fixing unit 36 is in the receding position (receding state).

Further, the protect member 41 is moved in the direction denoted by the arrow E (see FIG. 4) by 10 mm due to the force of the elastic member 53, when the lock member 52 is unlocked and the fixing unit 36 is moved to the receding position. With this function, when the fixing unit 36 at the receding position is moved to be back in the printer, the protect member 41 will touch or collide with such as a frame of the printer, thereby preventing the fixing unit 36 from being broken by directly touching or colliding with such as a frame of the printer.

Note that, the receding position of the fixing unit 36 is not limited to the rear side of the printer. For example, the fixing unit 36 may be receded in a direction further downward of the printer. With this arrangement, by moving the fixing unit 36 downward the printer, the user more easily put his/her hand from an upper portion of the printer at the sheet jam operation, thus providing the largest working space.

As described, the printer (image forming device) of the present invention includes: a processing unit such as a fixing unit 36 for fixing toner on a sheet carried between a pair of rotatable rollers 31 and 32, wherein: the armored unit 12 having a guide member 40 for movably supporting the fixing unit 36 is pulled out of the main body of the printer in a sheet carriage direction with respect to the fixing unit 36, and then the guide member 40 further moves the fixing unit 36 from the operation side to the rear side of the printer (a direction orthogonal to the sheet carriage direction) and in a direction away from the side cover 30.

In the foregoing arrangement, when a trouble, such as sheet jam during the carriage, occurs in the device, the fixing unit 36 is pulled out and exposed with the armored unit 12 including such as the side cover 30, and then is pushed in in an orthogonal direction to the direction in which the fixing unit 36 was pulled out.

This arrangement allows a user to more easily look inside of the device compared to the case of just pulling out the fixing unit 36 forward (to the user's side). Therefore, at an operation for dealing with a trouble, such as sheet jam (sheet jam operation), it is possible to carry out the operation without being interrupted by the fixing unit 36, thus reducing the opening width (opening space) of the fixing unit 36.

Consequently, sufficient space is ensured for removing a jammed sheet by hand with a small opening space at the sheet jam operation.

Further, the printer includes a display section, provided on an operation side of the main body of the printer, for allowing a user to carry out operations of the printer. Further, a guide hole 40*a* is formed on the guide member 40. The guide member 40 moves (pushes in) the fixing unit 36 in a direction away from the display section, i.e., the operation side of the user.

The fixing unit 36 is generally a heat-fixing unit, and when the fixing unit 36 is pulled out of the printer so as to carry out sheet jam operation, the fixing unit 36 in high temperature is exposed.

However, the fixing unit 36 is moved by the guide hole 40*a* formed on the guide member 40 in a direction away from the display section; namely, when the orthogonal direction of the sheet carriage direction extends from the operation side having the display section to the rear side of the printer, the sheet jam operation can be carried out more safely since it is not necessary to pull out the fixing unit 36 in high temperature to the operation side.

Further, the fixing unit 36 can be used even when the unit is slightly shifted from the original position. Accordingly, when the fixing unit 36 is shifted to be brought back to the device after pulled out of the device for sheet jam operation, there will be no effect on image forming operation. Therefore, the lock member 52 is not necessarily required though it is still preferably used for securely fixing the position of the fixing unit 36 in operation.

Consequently, it is possible to provide a printer, which ensures sufficient space for removing a jammed sheet by hand with a small opening space at the sheet jam operation, with a simple structure.

The printer further includes a carriage section S' (carriage path) in which the sheet is carried to be discharged. The carriage section S' is provided between a side cover 30 and the fixing unit 36.

With this arrangement, when the fixing unit 36 is moved with respect to the armored unit 12, the fixing unit 36 is moved in a direction opposite to the pulled out direction. Therefore, it is possible to widen the carriage section S', thus more easily carrying out sheet jam operation occurred between the fixing unit 36 and the side cover 30.

Further, the armored unit 12 includes a protect member 41 which moves with fixing unit 36 when the fixing unit 36 is moved away from the operation side, so that a distance between the exposed fixing unit 36 and the main body of the printer is kept at or longer than a predetermined length, thus safely carrying out sheet jam operation.

Further, with this function, when the fixing unit 36, mistakenly still kept in the receding position, is moved back in the printer with the armored unit 12, the protect member 41 prevents the operation for bringing back the fixing unit 36 and the armored unit 12.

On this account, it is possible to prevent breakage of the fixing unit 36 and the components such as the armoring (for example, the back cover) or the frame, by directly touching or colliding with each other.

As described, an image forming device of the present invention includes:

a processing unit for image forming to which a recording medium is sequentially carried for forming an image on the recording medium; and an armored unit as a part of armoring, which is capable of being exposed out of a main body of the image forming device, wherein: the processing unit is pulled out with the armored unit to be exposed out of the main body of the image forming device, and then is moved by being pushed in in a direction orthogonal to the direction in which the processing unit was pulled out.

With the foregoing arrangement, the processing unit is pulled out and exposed with the armored unit and is further moved by being pushed in in a direction orthogonal to the pulled out direction. Thus, a sufficient space is ensured for the working space for medium jam operation etc. with respect to the main body of the image forming device, and also the processing unit is receded from the working side.

On this account, the working space for the sheet jam operation etc. is ensured even with a small pull out quantity of the armored unit, thus reducing occupancy area of the image forming device at a normal use.

In the foregoing image forming device, it is preferable that the processing unit is moved in a direction away from a working side where a user carries out medium jam operation with respect to the image forming device.

Normally, if the processing unit is further moved to the operation side (the side where image forming or medium jam operation is carried out) after being pulled out with the armored unit, the pulled out processing unit would interrupt the operation.

However, in the foregoing arrangement, the processing unit is moved (pushed in) in the opposite direction of the operation side, and therefore a sufficient working space for medium jam operation etc. with respect to the upper side of the processing unit (the main body of the image forming device) is ensured without interruption of the processing unit.

On this account, the medium jam operation etc. can be carried out easily and safely. Further, the working space for the medium jam operation etc. is ensured even with a small pull out quantity of the armored unit, thus reducing occupancy area of the image forming device at a normal use.

In the foregoing image forming device, it is preferable that the processing unit includes a carriage member, which is rotatable, for carrying the recording medium; and the processing unit is pulled out with the armored unit to be out of the main body of the image forming device in a direction orthogonal to an axis direction of the carriage member.

In the foregoing arrangement, the processing unit is pulled out with the armored unit in a direction orthogonal to the axis direction of the carriage member, which is included in the processing unit for carrying a recording medium. Thus, the carriage path is opened in the carriage direction of the recording medium, or is opened in a parallel direction to the recording medium carriage direction.

With this arrangement, when the recording medium exists between plural processing units, for example, the processing unit can be pulled out with the armored unit without breakage of the recording medium. Further, the processing unit can be further moved (pushed in) after taking out the recording medium caught between the plural processing units, so as to easily carry on the medium jam operation etc.

In the foregoing image forming device, it is preferable that the armored unit includes a guide member for supporting the processing unit so that the processing unit is movable in the direction orthogonal to the direction in which the processing unit was pulled out; and the guide member has a protect member, which moves with the processing unit when the processing unit is moved after being pulled out with the armored unit, for preventing the armored unit from being moved back inside of the image forming device with the processing unit at the moved position.

With the foregoing arrangement, when the fixing unit, mistakenly still shifted (kept in the receding position), is moved back in the image forming device with the armored unit, the protect member prevents the operation for bringing back the fixing unit and the armored unit.

On this account, it is possible to prevent breakage of the processing unit and the armoring or the frame of the image forming device by directly touching or colliding with each other.

In the foregoing image forming device, it is preferable that the armored unit includes a guide member for supporting the processing unit so that the processing unit is movable in the direction orthogonal to the direction in which the processing unit was pulled out; and the guide member has a lock member for fixing movement of the processing unit with respect to the guide member at a movement end in the image forming device at least where the processing unit carries out image forming.

With this arrangement, when the processing unit and the armored unit are moved back to the original position after being pulled out for the medium jam operation, it is possible to keep the processing unit fixed in the right position (fixed position where the image forming is carried out) so as not to be easily moved due to vibration from the movement.

Further, by providing the lock member also on the receding position of the fixing unit, the fixing unit will not move during the medium jam operation etc., thereby ensuring the working space for the operation.

In the foregoing image forming device, it is preferable that the armored unit includes a guide member for supporting the processing unit so that the processing unit is movable in the direction orthogonal to the direction in which the processing unit was pulled out; and the guide member stops the movement of the processing unit before an armored surface of the main body of the image forming device, which is provided in a direction in which the processing unit is moved.

With this arrangement, the further movement of the processing unit after being exposed out of the image forming device is stopped before the surface of the armoring of the image forming device, which is provided in the moving direction of the processing unit. Thus, it is possible to prevent the processing unit from being bounced out of the armoring of the image forming device.

On this account, it is possible to prevent crush of the processing unit with such as a wall, thereby preventing the scratch of the wall or breakage of the processing unit.

In the foregoing image forming device, it is preferable that the processing unit is a fixing unit for fixing a toner image formed on the recording medium.

On this account, in the fixing unit where the medium jam often occurs, the working space for the medium jam operation etc. is ensured even with a small pull out quantity of the armored unit, thus reducing occupancy area of the image forming device at a normal use.

Further, the further movement of the fixing unit after being exposed out of the image forming device is stopped before the surface of the armoring of the image forming device, which is provided in the moving direction of the fixing unit. Thus, it is possible to prevent the fixing unit from being bounced out of the armoring of the image forming device.

On this account, it is possible to prevent crush of the fixing unit with such as a wall, thereby preventing the scratch of the wall or breakage of the fixing unit.

In the foregoing image forming device, it is preferable that opening restricting means for restricting a pull out quantity of the armored unit, and the pull out quantity of the processing unit is extendable by canceling the restriction of the opening restricting means.

With this arrangement, the pull out quantity of the armored unit from the image forming device can be restricted by the opening restricting means, and therefore, at a normal use, the pull out quantity of the armored unit can be set relatively small for a normal use for smoothly carrying out the medium jam operation, thus reducing occupancy area for using the image forming device.

Further, when maintenance of the image forming device is carried out, the opening space of the armored unit can be extended to be greater than that in normal use by canceling the opening restricting means. Thus, at maintenance for exchanging a transfer belt etc., the processing unit including a transfer belt can easily be taken out from the image forming device.

The image forming device of the present invention includes:

a fixing unit for fixing a toner image formed on a recording medium; and an armored unit as a part of armoring, which is capable of being exposed out of a main body of the image forming device, wherein: the fixing unit is pulled out with the armored unit to be out of the main body of the image forming device, and then is moved by being pushed in in a direction orthogonal to the direction in which the fixing unit was pulled out.

With the foregoing arrangement, the fixing unit is pulled out and exposed with the armored unit and is further moved by being pushed in in a direction orthogonal to the pulled out direction. Thus, a sufficient space is ensured for the working space for medium jam operation etc. with respect to the main body of the image forming device, and also the fixing unit in high temperature is receded from the working side.

On this account, the medium jam operation etc. can be carried out easily and safely. Further, the working space for the medium jam operation etc. is ensured even with a small pull out quantity of the armored unit, thus reducing occupancy area of the image forming device at a normal use.

In the foregoing image forming device, it is preferable that the image forming device further includes:

a display section, provided on an operation side of the main body of the image forming device, for allowing a user to carry out operations of the image forming device, and the fixing unit is moved in a direction away from the operation side.

Normally, if the fixing unit is further moved to the operation side (the side where image forming or medium jam operation is carried out) after being pulled out with the armored unit, the pulled out fixing unit would interrupt the operation.

However, in the foregoing arrangement, the fixing unit is moved (pushed in) in the opposite direction of the operation side, and therefore a sufficient working space for medium jam operation etc. with respect to the upper side of the fixing unit (the main body of the image forming device) is ensured without interruption of the processing unit. Also the fixing unit in high temperature can be receded to the rear side of the image forming device.

On this account, the medium jam operation etc. can be carried out easily and safely. Further, the working space for the medium jam operation etc. is ensured even with a small pull out quantity of the armored unit, thus reducing occupancy area of the image forming device at a normal use.

In the foregoing image forming device, it is preferable that the armored unit includes a guide member for supporting the fixing unit so that the fixing unit is movable in the direction orthogonal to the direction in which the fixing unit was pulled out, and the guide member moves the fixing unit in a direction away from the armored unit.

With this arrangement, the fixing unit is moved in a direction away from the armoring of the armored unit (in an opposite direction to the pulled out direction) by being shifted (pushed in) from the operation side (the side where image forming or medium jam operation is carried out) after being pulled out and exposed with the armored unit.

Thus, a sufficient working space for medium jam operation etc. with respect to the upper side of the fixing unit (the main body of the image forming device) is ensured, and also, the carriage path provided in the lower side of the fixing unit can be opened.

In the foregoing image forming device, it is preferable that the image forming device further includes:

a carriage path, provided between the armored unit and the fixing unit, for carrying the recording medium carried from the fixing unit.

With this arrangement, it is possible to widen the carriage path, as it is provided between the armored unit and the fixing unit, thus more easily carrying out medium jam operation occurred between the armored unit and the fixing unit, for example.

In the foregoing image forming device, it is preferable that the fixing unit thus exposed with the armored unit out of the main body of the image forming device includes a protect member which simultaneously moves with the fixing device when the fixing device moves away from the operation side, so that a distance between the armored unit thus exposed and the main body of the image forming device is kept at or longer than a predetermined length.

With the foregoing arrangement, when the fixing unit, mistakenly still shifted (kept in the receding position), is moved back in the image forming device with the armored unit, the protect member prevents the operation for bringing back the fixing unit and the armored unit.

On this account, it is possible to prevent breakage of the fixing unit and the armoring or the frame of the image forming device by directly touching or colliding with each other.

In the foregoing image forming device, it is preferable that the armored unit includes a guide member for supporting the fixing unit so that the fixing unit is movable in the direction orthogonal to the direction in which the fixing unit was pulled out; and the guide member has a lock member for fixing movement of the fixing unit with respect to the guide member at a movement end in the image forming device at least where the fixing unit carries out image forming.

With this arrangement, when the fixing unit and the armored unit are moved back to the original position after being pulled out for the medium jam operation, it is possible to keep the fixing unit fixed in the right position (fixed position where the image forming is carried out) so as not to be easily moved due to vibration from the movement.

Further, by providing the lock member also on the receding position of the fixing unit, the fixing unit will not move during the medium jam operation etc., thereby ensuring the working space for the operation.

In the foregoing image forming device, it is preferable that the armored unit includes a guide member for supporting the fixing unit so that the fixing unit is movable in the direction orthogonal to the direction in which the fixing unit was pulled out; and the guide member stops movement of the fixing unit before an armored surface of the main body of the image forming device, which is provided in a direction in which the fixing unit is moved.

With this arrangement, the further movement of the fixing unit after being exposed out of the image forming device is stopped before the surface of the armoring of the image forming device, which is provided in the moving direction of the fixing unit. Thus, it is possible to prevent the fixing unit from being bounced out of the armoring of the image forming device. On this account, for, example, it is possible to prevent crush of the fixing unit with such as a wall, thereby preventing the scratch of the wall or breakage of the fixing unit.

In the foregoing image forming device, it is preferable that the image forming device further includes:

opening restricting means for restricting a pull out quantity of the armored unit, and the pull out quantity of the processing unit is extendable by canceling the restriction of the opening restricting means.

With this arrangement, the pull out quantity of the armored unit from the image forming device can be restricted by the opening restricting means, and therefore, at a normal use, the pull out quantity of the armored unit can be set relatively small for a normal use for smoothly carrying out the medium jam operation, thus reducing occupancy area for using the image forming device. Further, when maintenance of the image forming device is carried out, the opening space of the armored unit can be extended to be greater than that in normal use by canceling the opening restricting means. Thus, at maintenance for exchanging a transfer belt etc., the processing unit including a transfer belt can easily be taken out from the image forming device.

In the foregoing image forming device, it is preferable that the fixing unit includes end portions for giving and receiving motive power between the fixing unit and the main body of the image forming device, and each periphery of the end portions is covered with a heat-resistant material.

With this arrangement, by covering each periphery of the end portions of the fixing unit for giving and receiving motive power between the fixing unit and the main body of the image forming device, it is possible to prevent the end portions from being easily damaged or stained even when the end portions are accidentally touched with things placed near the rear surface of the printer. Further, it is possible to reduce radiation from the fixing device.

In the foregoing image forming device, it is preferable that the heat-resistant material is made of a resin.

With this arrangement, by using a resin preferably having low degree of heat conductivity and superior adiathermancy, it is possible to prevent direct contact with the fixing unit by a user even when the user mistakenly touches the fixing unit in high temperature. Further, it is possible to reduce radiation from the fixing device.

Note that, in the explanation above, the guide member is provided in the armoring unit. The following will describe the case where the fixing unit (processing unit) includes a guide member (guide member 40) and/or a protect member (protect member 41) in addition to a fixing device (fixing unit 36) having a heat roller and a pressure roller.

The image forming device of the present invention includes:

a fixing unit including a fixing device for fixing toner on a recording medium carried between a pair of rotatable rollers, wherein: the fixing unit has a guide member for movably supporting the fixing device, and when the fixing unit is pulled out of a main body of the image forming device in a recording medium carriage direction with respect to the fixing device, the guide member moves the fixing device in a direction opposite and perpendicular to the recording medium carriage direction.

In the foregoing arrangement, when a trouble, such as medium jam during the carriage, occurs in the device, the fixing unit is pulled out and exposed, and then is moved in an orthogonal direction to the direction in which the fixing unit was pulled out, and in a direction perpendicular to the recording medium carriage direction.

This arrangement allows a user to more easily look inside of the device compared to the case of just pulling out the fixing unit. Therefore, at an operation for dealing with a trouble, such as medium jam (medium jam operation), it is possible to carry out the operation without being interrupted by the fixing unit, thus reducing the opening width (opening space) of the fixing unit.

Consequently, it is possible to provide an image forming device ensuring sufficient space for removing a jammed medium by hand with a small opening space at the medium jam operation.

In the foregoing image forming device, it is preferable that the device further includes:

a display section, provided on an operation side of the main body of the image forming device, for allowing a user to carry out operations of the image forming device, the guide member moving the fixing device in a direction away from the operation side.

The fixing device is generally a heat-fixing unit, and when the fixing unit is pulled out of the image forming device so as to carry out medium jam operation, the fixing device in high temperature is also pulled out with the fixing unit thus pulled out of the device.

However, with the foregoing arrangement, the guide member moves the fixing device in a direction away from the display section. Namely, when the orthogonal direction of the medium carriage direction extends from the operation side having the display section, where a user carries out operation of the image forming device, to the rear side of the image forming device, the medium jam operation can be carried out more safely since it is not necessary to pull out the fixing device in high temperature to the operation side.

The foregoing image forming device is preferably arranged such that the guide member has an opening section for guiding the fixing device in the moving direction.

With this arrangement, it is possible to move the fixing device with a simple structure by latching the fixing device in the opening section with a shoulder screw or the like.

In the foregoing image forming device, it is preferable that the device further includes:

a carriage path in which the recording medium is carried to be discharged, and the carriage path is provided between an armored unit constituting armoring of the image forming device and the fixing unit.

With this arrangement, when the fixing device is pulled out with respect to the armored unit, the fixing device is moved in a direction opposite to the pulled out direction. Therefore, it is possible to widen the carriage section, thus more easily carrying out medium jam operation occurred between the fixing unit and the armored unit.

The foregoing image forming device is preferably arranged such that the guide member has a lock member for fixing a position of the fixing device thus pulled with the fixing unit out of the main body of the image forming device and is to be further moved, and the lock member fixes the position of the fixing device at a movement end at least on a portion where the fixing unit carries out image forming in the image forming device.

Further, the foregoing image forming device is preferably arranged such that the fixing device includes end portions for giving and receiving motive power between the fixing device and the main body of the image forming device, and each periphery of the end portions is covered with a heat-resistant material.

The foregoing image forming device is preferably arranged such that the heat-resistant material is made of a resin.

The foregoing image forming device is preferably arranged such that the fixing unit is pulled out of the main body of the image forming device with a part of an armored unit constituting armoring of the image forming device.

Further, the image forming device of the present invention includes:

a plurality of processing units for image forming in which an image is formed on a recording medium sequentially carried to the plurality of processing units, wherein: at least one processing unit is exposed out of a main body of the image forming device with a part of an armored unit of the image forming device at medium jam operation, and the exposed processing unit includes a processing device which partially or entirely constitutes the processing unit, and is supported while being movable in a direction away from an operation side of the main body of the image forming device, and the operation side includes a display section for carrying out operation for the image forming device.

In the foregoing arrangement, when a trouble, such as recording medium jam during the carriage, occurs in the device, an armored unit, which partially constitute armoring of the image forming device, is pulled out with the processing unit, and also, the processing unit is pulled out and moved (receded) in a direction (for example, to the opposite direction) away from the operation side where the medium jam operation is normally performed instead of being pulled out toward the operation side.

This arrangement allows a user to more easily look inside of the device at an operation for dealing with a trouble, such as recording medium jam (recording medium jam operation), compared to the case of just pulling out the processing unit. Therefore, it is possible to carry out the operation without being bothered by the processing unit, and to reduce the opening width (opening space) of the processing unit.

Consequently, it is possible to provide an image forming device ensuring sufficient space for removing a jammed recording medium by hand with a small opening space of the image forming device at the recording medium jam operation.

In the foregoing image forming device, it is preferable that the device further includes:

a guide member for supporting only the processing device included in the exposed processing unit thus pulled out with the part of the armored unit, and the processing device is supported while being movable in a direction away from the operation side and opposite to a direction in which the processing device is moved when the processing device is exposed with the part of the armored unit.

In the case of providing a carriage direction switching gate for controlling the carriage route of a recording medium, the foregoing arrangement makes it possible to move the processing device without being bothered by the carriage direction switching gate even when it overlaps the processing unit.

Further, when the processing unit to be moved is a fixing unit, it is possible to move a part of the fixing unit while avoiding the carriage section provided between the armored unit and the fixing unit.

Consequently, it is possible to ensure sufficient space for removing a jammed recording medium by hand with a small opening space of the image forming device at the recording medium jam operation.

In the foregoing image forming device, it is preferable that the device further includes:

a carriage path in which the recording medium is carried to be discharged from the processing unit, and the carriage path is provided between the part of the exposed armored unit and processing unit, and the guide member moves the processing unit so as to widen the carriage path.

With this arrangement, it is possible to provide a wider carriage path between the part of the armored unit and the processing unit, thus easily performing medium jam operation for a jammed medium between the fixing unit and the armored unit.

The foregoing image forming device is preferably arranged such that the processing unit exposed out of the image forming device has a protect member which simultaneously moves with the processing device when the processing device moves away from the operation side, so that a distance between the exposed processing unit and the main body of the image forming device is kept at or longer than a predetermined length.

With this function, when the processing device, mistakenly still kept in the receding state, is moved back in the image forming device with the part of the armored unit, the protect member prevents the processing unit and the armored unit from being brought back to the image forming device.

On this account, it is possible to prevent the fixing unit from being broken by directly touching or colliding with the armored unit of the image forming device, such as a frame.

The foregoing image forming device is preferably arranged such that the guide member has a lock member for fixing a position of the processing device at a movement end on a portion in the image forming device at least where the processing unit carries out image forming.

With this arrangement, when the processing unit and the armored unit are moved back to the original position after being pulled out for the medium jam operation, it is possible to keep the processing device in the right position (fixed position in the image forming device, where image forming operation is performed) so that the processing device is not easily moved due to vibration from the movement.

Further, when the lock member is provided for fixing a position of the processing device which is moved for the medium jam operation, the processing device stays in the fixed position during the operation, thus ensuring the working space.

The foregoing image forming device is preferably arranged such that the lock member is made of a plastic having elasticity.

The foregoing image forming device is preferably arranged such that the guide member has an opening section for guiding the processing device to be moved in a direction parallel to the recording medium carried to the processing unit exposed out of the image forming device, and in a direction perpendicular to a carriage direction of the recording medium.

With this arrangement, it is possible to accurately mount the armored unit and the processing unit on a right position. Namely, it is possible to prevent the processing unit from being inclined at the image forming.

The foregoing image forming device is preferably arranged such that the guide member stops the movement of the processing device short of touching a surface of the armored unit of the main body of the image forming device, which is provided in a direction to which the processing device is moved.

With this arrangement, it is possible to prevent the processing unit from being bounced out of the armored unit of the image forming device. Thus, it is possible to prevent crush of the processing device with such as a wall, thereby preventing the scratch of the wall or breakage of the processing unit.

The foregoing image forming device is preferably arranged such that the exposed processing unit is a fixing unit having a fixing device which fixes an transferred image on the recording medium.

With this arrangement, the medium jam operation can be carried out without pulling the fixing unit generating heat and in high temperature out of the printer (to the operation side), thus ensuring the working space as well as safety.

Further, the fixing unit may be used even when it is slightly shifted from an original position. Accordingly, when the fixing unit is shifted when it is brought back to the image forming device after pulled out of the device for medium jam operation, there will be no effect on image forming operation.

Consequently, it is possible to provide an image forming device ensuring sufficient space for removing a jammed medium by hand with a small opening space of the image forming device at the medium jam operation, with a simple structure.

The foregoing image forming device is preferably arranged such that the fixing device includes end portions for giving and receiving motive power between the fixing device and the main body of the image forming device, and each periphery of the end portions is covered with a heat-resistant material.

With this arrangement, it is possible to prevent the ends from being damaged or stained even when the ends are accidentally touched with things placed near the rear surface of the image forming device. Further, it is possible to reduce radiation from the fixing device.

The foregoing image forming device is preferably arranged such that the heat-resistant material is made of a resin.

With this arrangement, it is possible to prevent direct contact with the fixing device by a user even when the user mistakenly touches the fixing unit in high temperature. Further, it is possible to reduce radiation from the fixing device.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An image forming device, comprising:

a fixing unit for image forming to which a recording medium is sequentially carried for forming an image on the recording medium, the fixing unit for fixing a toner image formed on the recording medium; and an armored unit as a part of armoring, which is capable of being exposed out of a main body of the image forming device, wherein:

the fixing unit is pulled out with the armored unit to be exposed out of the main body of the image forming device, and then is moved at least partially beyond the rear of the main body of the image forming device by being pushed in a direction orthogonal to the direction in which the fixing unit was pulled out.

2. The image forming device as set forth in claim 1, wherein:

the fixing unit is moved in a direction away from a working side where a user carries out medium jam operation with respect to the image forming device.

3. The image forming device as set forth in claim 1, wherein:

the fixing unit includes a carriage member, which is rotatable, for carrying the recording medium, and the fixing unit is pulled out with the armored unit to be out of the main body of the image forming device in a direction orthogonal to an axis direction of the carriage member.

4. The image forming device as set forth in claim 1, wherein:

the armored unit includes a guide member for supporting the fixing unit so that the fixing unit is movable in the direction orthogonal to the direction in which the fixing unit was pulled out, and the guide member has a protect member, which moves with the fixing unit when the fixing unit is moved after being pulled out with the armored unit, for preventing the armored unit from being moved back inside of the image forming device with the fixing unit at the moved position.

5. The image forming device as set forth in claim 1, further comprising:

a display section, provided on an operation side of the main body of the image forming device, for allowing a user to carry out operations of the image forming device, the fixing unit being moved in a direction away from the operation side.

6. The image forming device as set forth in claim 1, wherein:

the armored unit includes a guide member for supporting the fixing unit so that the fixing unit is movable in the direction orthogonal to the direction in which the fixing unit was pulled out, and the guide member moves the fixing unit in a direction away from the armored unit.

7. The image forming device as set forth in claim 1, further comprising:

a carriage path, provided between the armored unit and the fixing unit, for carrying the recording medium carried from the fixing unit.

8. The image forming device as set forth in claim 1, wherein:

the fixing unit thus exposed with the armored unit out of the main body of the image forming device includes a protect member which simultaneously moves with the fixing unit when the fixing unit moves away from the operation side, so that a distance between the armored unit thus exposed and the main body of the image forming device is kept at or longer than a predetermined length.

9. The image forming device as set forth in claim 1, wherein:

the armored unit includes a guide member for supporting the fixing unit so that the fixing unit is movable in the direction orthogonal to the direction in which the fixing unit was pulled out, and the guide member has a lock member for fixing movement of the fixing unit with respect to the guide member at a movement end in the image forming device at least where the fixing unit carries out image forming.

10. The image forming device as set forth in claim 1, wherein:

the armored unit includes a guide member for supporting the fixing unit so that the fixing unit is movable in the direction orthogonal to the direction in which the fixing unit was pulled out, and the guide member stops movement of the fixing unit before an armored surface of the main body of the image forming device, which is provided in a direction in which the fixing unit is moved.

11. The image forming device as set forth in claim 1, further comprising:

opening restricting means for restricting a pull out quantity of the armored unit, the pull out quantity of the fixing unit being extendable by canceling the restriction of the opening restricting means.

12. The image forming device as set forth in claim 1, wherein:

the fixing unit includes end portions for giving and receiving motive power between the fixing unit and the main body of the image forming device, and each periphery of the end portions is covered with a heat-resistant material.

13. The image forming device as set forth in claim 12, wherein: the heat-resistant material is made of a resin.

14. The image forming device as set forth in claim 1, wherein:

the fixing unit is pulled out with the armored unit to be exposed out of the main body of the image forming device, and then is moved in a direction orthogonal to the directional in which the fixing unit pulled was out and pushed in a direction in parallel to the direction in which the fixing unit was pulled out.

15. An image forming device, comprising:

a fixing unit for image forming to which a recording medium is sequentially carried for forming an image on the recording medium, the fixing unit for fixing a toner image formed on the recording medium; and an armored unit as a part of armoring, which is capable of being exposed out of a main body of the image forming device, wherein:

the fixing unit is moveable at least partially beyond the rear of the main body of the image forming device, and as a result of the movement a space suitable for working is ensured between the armored unit and the fixing unit.

* * * * *